US005529355A

United States Patent [19]

Fukumoto

[11] Patent Number: 5,529,355

[45] Date of Patent: Jun. 25, 1996

[54] VEHICLE DOOR LOCK APPARATUS

[75] Inventor: Ryoichi Fukumoto, Nagoya, Japan

[73] Assignee: Aisin Seiki Kabushiki Kaisha, Kariya, Japan

[21] Appl. No.: 233,258

[22] Filed: Apr. 26, 1994

[30] Foreign Application Priority Data

Apr. 27, 1993 [JP] Japan ..... 5-101443

[51] Int. Cl.[6] ..... E05C 3/26

[52] U.S. Cl. ..... 292/337; 292/201; 292/DIG. 23

[58] Field of Search ..... 70/54–56; 292/201, 292/216, 336.3, 337, DIG. 23

[56] References Cited

U.S. PATENT DOCUMENTS

| | | | |
|---|---|---|---|
| 3,828,591 | 8/1974 | Beaver | 70/56 |
| 3,983,725 | 10/1976 | Manuel et al. | 70/55 |
| 4,911,486 | 3/1990 | Anderson | 70/54 |
| 5,028,084 | 7/1991 | Fukumoto et al. | 292/337 |
| 5,092,143 | 3/1992 | Rumbles | 70/56 |

FOREIGN PATENT DOCUMENTS

| | | | |
|---|---|---|---|
| 969993 | 6/1975 | Canada | 70/54 |
| 2-221578 | 9/1990 | Japan . | |

*Primary Examiner*—Steven N. Meyers
*Assistant Examiner*—Tuyet-Phuong Pham
*Attorney, Agent, or Firm*—Burns, Doane, Swecker & Mathis

[57] ABSTRACT

A vehicle door lock apparatus includes a body for being fixed to a mounting portion of a door, a latch mechanism disposed in the body, a case for being disposed between the mounting portion of the door and the body, and an actuating mechanism surrounded by the body and the case. The case is joined with a fixed side of the body which faces and is opposite to the mounting portion of the door so that seepage of water into the body and damage to the actuating mechanism does not occur.

14 Claims, 7 Drawing Sheets

VEHICLE DOOR LOCK APPARATUS

BACKGROUND OF THE INVENTION

1. Field of the Invention

The present invention relates to a door lock apparatus, and more particularly to a door lock apparatus for a vehicle.

2. Description of the Related Art

A conventional vehicle door lock apparatus is disclosed in Japanese Patent Laid Open Publication No. 2(1990)-221578. The vehicle door lock apparatus disclosed in this document comprises a base member fixed to a door at one side thereof and having a latch mechanism stored therein. The vehicle door lock apparatus further comprises a case member mounted on the other side of the base member and an actuator surrounded by the base member and the case member.

However, in accordance with this type of door lock apparatus, since the case member is mounted on the side of the base member opposite the attachment side of the base member to the door, a seam portion of the base member and the case member is exposed to an inside of the door. Therefore, rainwater is likely to flow into the portion of the vehicle door lock apparatus in which the actuator is disposed through the seam portion of the base member and the case member.

SUMMARY OF THE PRESENT INVENTION

It is an object of the present invention to provide a vehicle door lock apparatus which can prevent rainwater from flowing into a portion of the apparatus in which an actuator is disposed.

It is another object of the present invention to provide a vehicle door lock apparatus which can be conveniently manufactured.

It is a further object of the present invention to provide a vehicle door lock apparatus which is durable.

It is a further object of the present invention to provide a vehicle door lock apparatus which is simple in structure and small in size.

It is a further object of the present invention to provide a vehicle door lock apparatus which is low in cost.

To achieve the above mentioned objects, a vehicle door lock apparatus in accordance with the present invention comprises a body adapted to be fixed to a mounting portion of a door, a latch mechanism disposed in the body, a case adapted to be disposed between the mounting portion of the door and the body, and an actuating mechanism surrounded by the body and the case. The case is joined with a fixed side of the body which faces or is opposite to the mounting portion of the door.

BRIEF DESCRIPTION OF THE DRAWINGS

The features and advantages of the vehicle door lock apparatus according to the present invention will become more apparent and will be more clearly appreciated from the following description considered in conjunction with the accompanying drawings in which like elements bear like reference numerals and wherein.

DETAILED DESCRIPTION OF THE PREFERRED EMBODIMENT OF THE INVENTION

Figure 1:
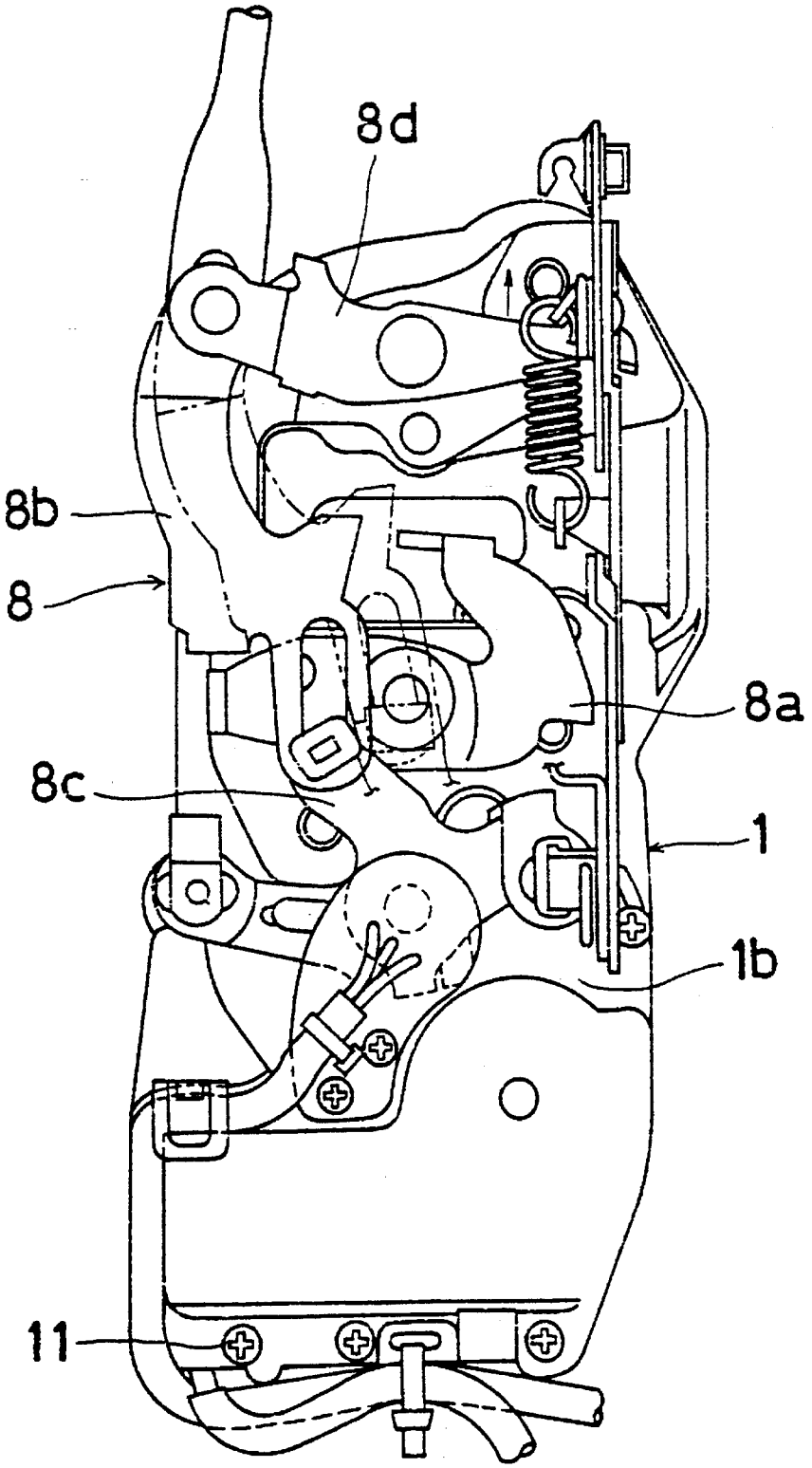
FIG. 1 is a plan view of a vehicle door lock apparatus of the present invention.
Figure 2:
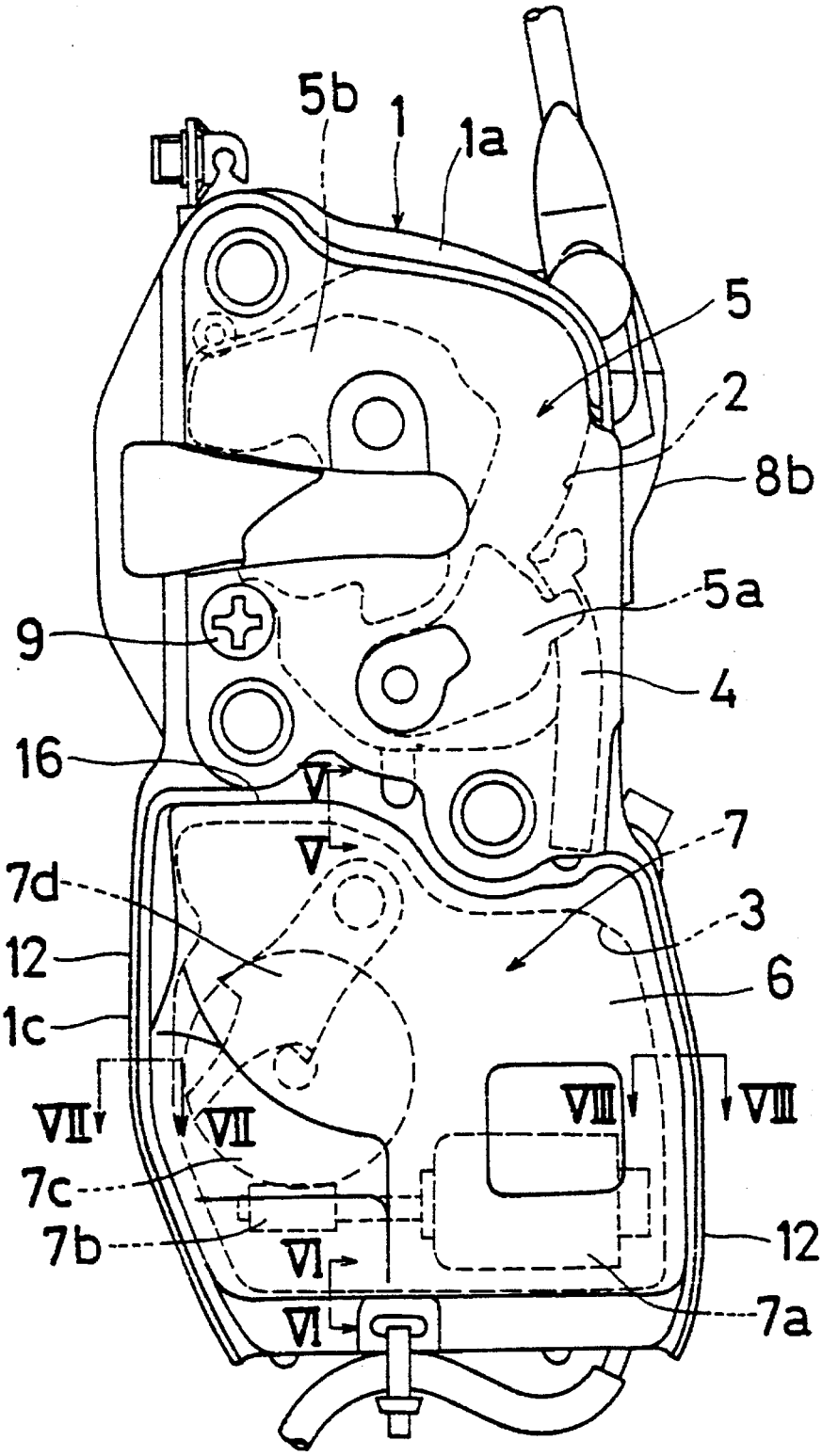
FIG. 2 is a rear elevational view of a vehicle door lock apparatus of the present invention.

Referring to FIGS. 1 and 2, a body 1 which is made of a synthetic resin includes a first concave portion 2 and a second concave portion 3 on a rear side 1*a*. The rear side 1*a* constitutes a fixed side of the body that is fixed or secured to the mounting portion of the vehicle door. The first concave portion 2 is closed by a plate 4 which is made of a metallic material. A latch mechanism 5 which is formed with a pole 5*a* and a latch 5*b* is disposed in the first concave portion 2. On the other hand, the second concave portion 3 is closed by a case 6 which is made of a synthetic resin. An actuating mechanism 7 is disposed in the second concave portion 3. The actuating mechanism 7 is comprised of an electric motor 7*a*, a worm gear 7*b*, a wheel gear 7*c* and an output lever 7*d*. Furthermore, a link mechanism 8 is disposed on a front side 1*b* of the body 1. The link mechanism 8 is comprised of a lift lever 8*a*, an opening lever 8*b* and a locking lever 8*c*.

The pole 5*a* and the latch 5*b* of the latch mechanism 5 are rotatably supported on the body 1. The latch 5*b* is engagable and disengagable with a striker 5*c* (shown in FIG. 9) of a vehicle body 15 and the pole 5*a* is engagable and disengagable with the latch 5*b*.

The electric motor 7*a* of the actuating mechanism 7 is fixed to the case 6, and the wheel gear 7*c* and the output lever 7*d* are rotatably supported on the body 1. The worm gear 7*b* is secured on an output shaft of the electric motor 7*a* and is adapted to be engaged with the wheel gear 7*c*. Further, an output lever 7*d* is provided for being engagable with the wheel gear 7*c*.

The lift lever 8*a* of the link mechanism 8 is rotatably supported on the body 1 and is connected with the pole 5*a*. The locking lever 8*c* is secured with a supporting shaft of the output lever 7*d* which passes through the body 1 in order to be rotated with the output lever 7*d*. Further, the opening lever 8*b* is swingably and slidably supported on the body 1 through a link 8*d*. The opening lever 8*b* is connected with the locking lever 8*c* and is engagable and disengagable with the lift lever 8*a*. The plate 4 is fixed on the rear side 1*a* of the body 1 with a bolt 9.

As shown in FIG. 1 and FIGS. 5–8, the case 6 is fixed on the rear side 1*a* of the body 1 with a plurality of screws 11.

A seal member 10 is interposed between the case 6 and the rear side 1*a*. Further, as seen in FIGS. 3–8, the body 1 includes a flange portion 12, which extends toward the case 6, on a side portion 1*c* of the body 1. A side seam portion 14 of the body 1 and the case 6 can be covered with the flange portion 12. The side seam portion 14 of the body 1 is formed at the juncture between the body 1 and the case at the left and right sides of the body which are the sides on the right and left of the body as seen with respect to the view shown in FIG. 2.

Figure 3:
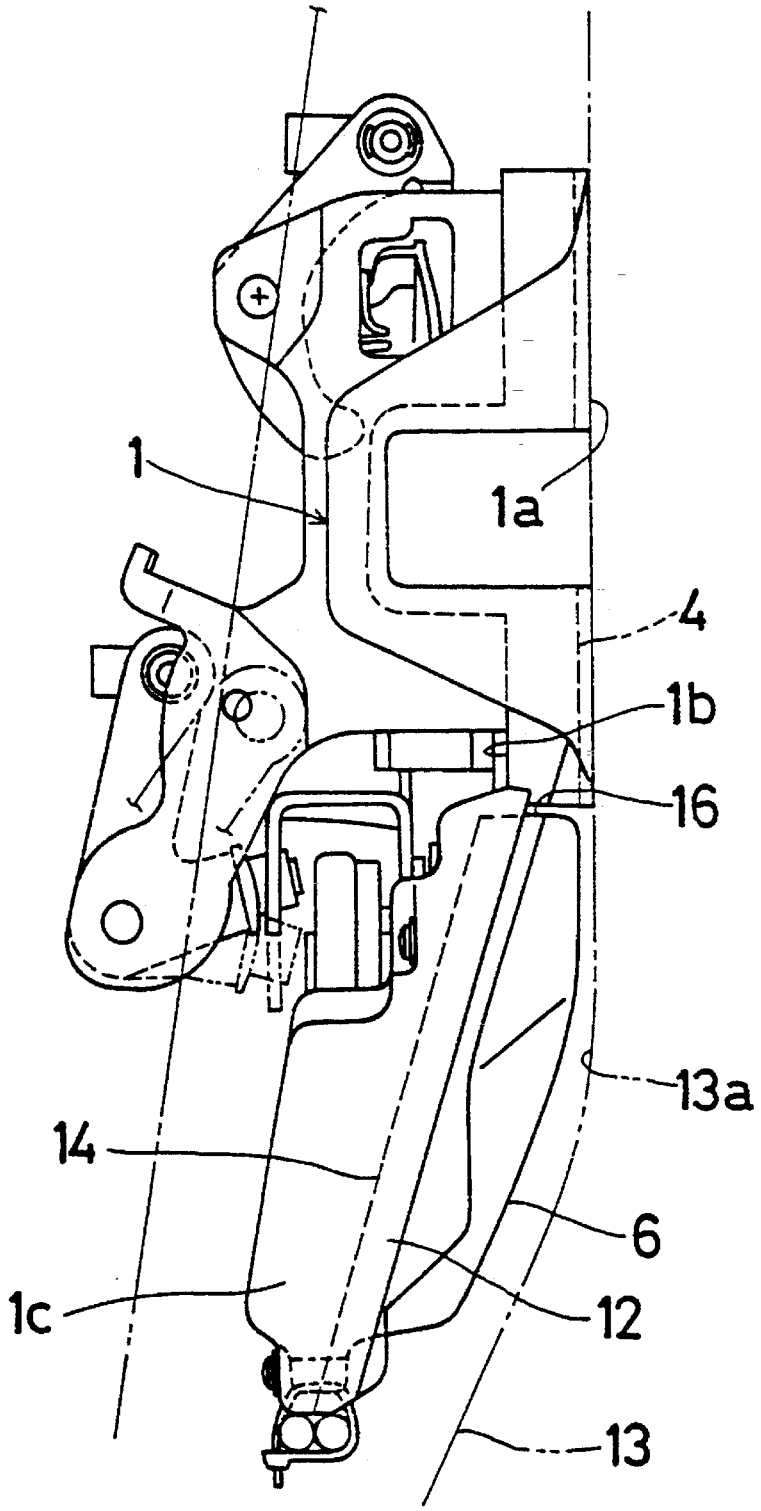
FIG. 3 is a side elevational view of a vehicle door lock apparatus of the present invention.
Figure 4:
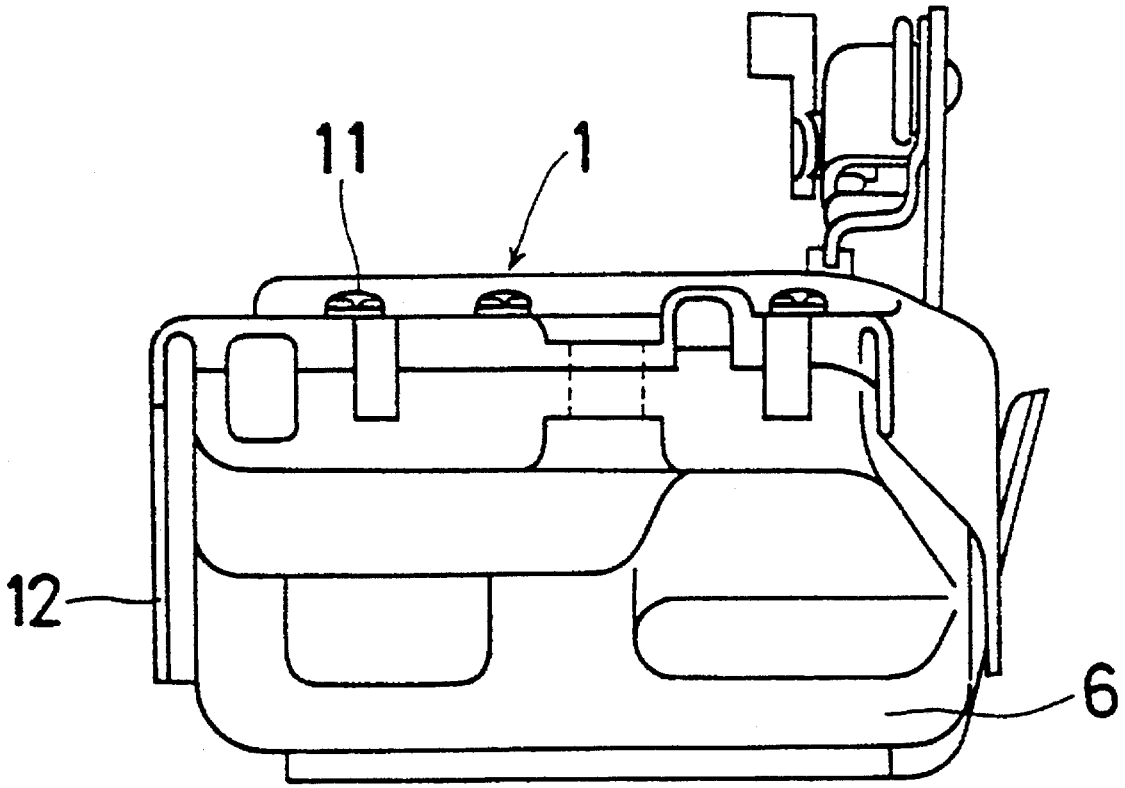
FIG. 4 is a bottom view of a vehicle door lock apparatus of the present invention.
Figure 5:
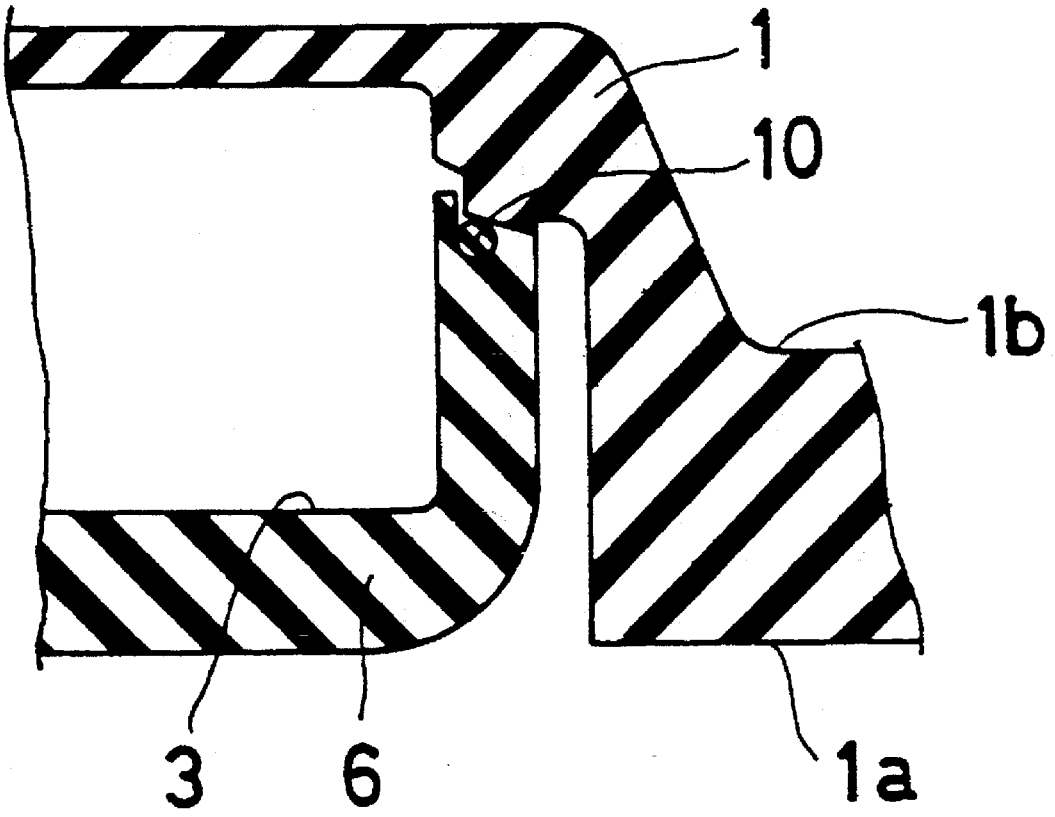
FIG. 5 is a sectional view of a vehicle door lock apparatus of the present invention taken on section line V—V of FIG. 2.
Figure 6:
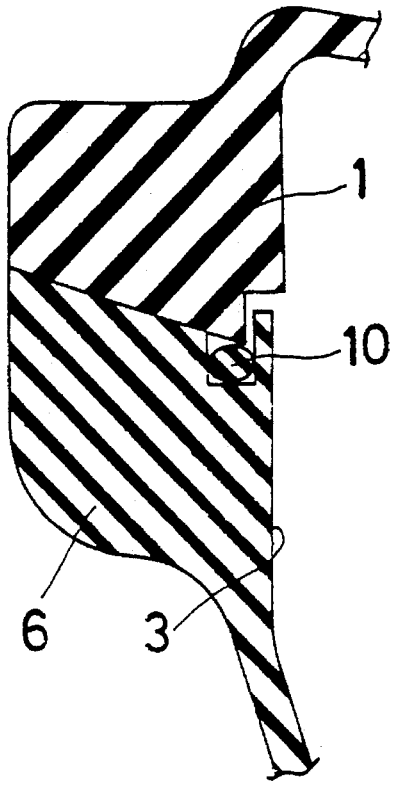
FIG. 6 is a sectional view of a vehicle door lock apparatus of the present invention taken on section line VI—VI of FIG. 2.
Figure 7:
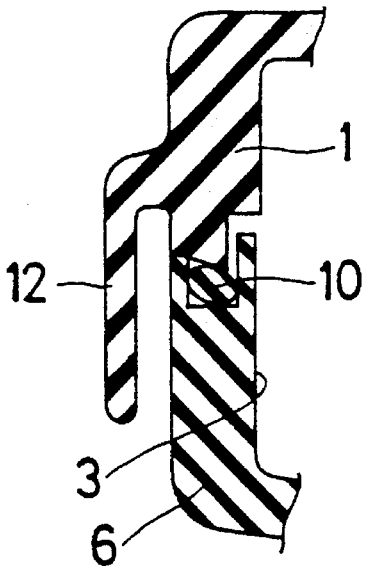
FIG. 7 is a sectional view of a vehicle door lock apparatus of the present invention taken on section line VII—VII of FIG. 2.
Figure 8:
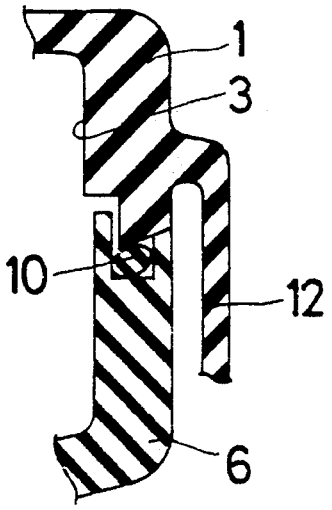
FIG. 8 is a sectional view of a vehicle door lock apparatus of the present invention taken on section line VIII—VIII of FIG. 2.
Figure 9:
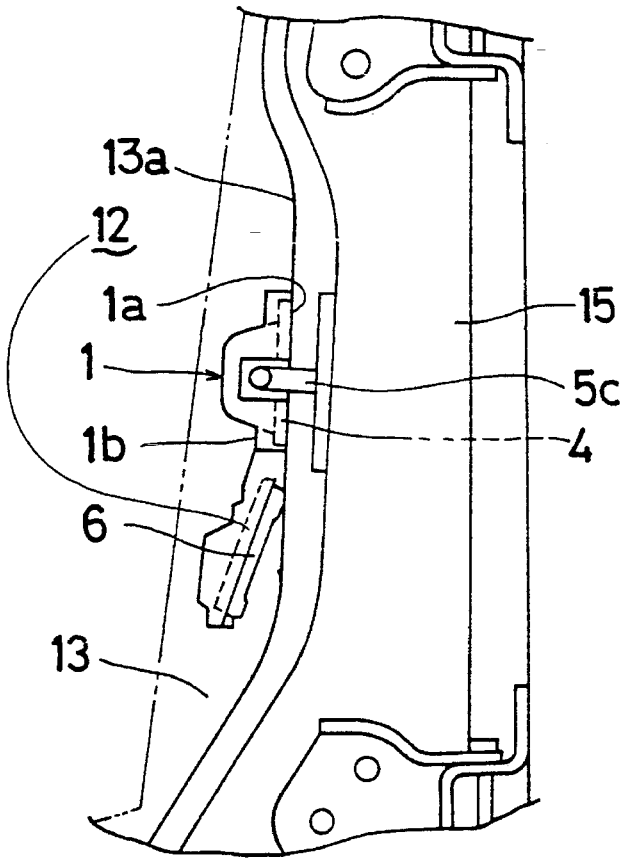
FIG. 9 is a side view of a vehicle door lock apparatus of the present invention showing a mounting condition of a vehicle door lock apparatus on a vehicle door.

As shown in FIGS. 3 and 9, the vehicle door lock apparatus of the invention is mounted on a vehicle door 13 which is swingably supported on the vehicle body 15 in order to locate the first concave portion 2 on an upper portion of the vehicle door 13 and the second concave portion 3 on a lower portion of the vehicle door 13. The rear side 1*a* of the body 1 of the vehicle door lock apparatus is secured on a mounting portion 13*a* of the vehicle door 13 with, for instance, a plurality of bolts (not specifically shown in the figures) in order to dispose the case 6 between the body 1 and the mounting portion 13*a*. Therefore, a rear seam portion 16 of the body and the case 6 can be covered with the body 1 and the mounting portion 13*a*. The rear seam portion 16 is located at the juncture between the body 1 and the case 6 at the upper side of the second concave portion 3 as seen in FIG. 2. The striker 5*c* for engaging and disengaging the latch 5*b* is fixed on a portion of the vehicle body 15 which is opposite to the mounting portion 13*a* of the vehicle door 13.

The operation of the vehicle door lock apparatus will now be described. When each of the striker 5*c* and the pole 5*a* is engaged with the latch 5*b* in order to prevent the latch 5*b* from rotating (the Latch Condition of the apparatus) and the opening lever 8*b* and the lift lever 8*a* are able to be engaged with each other (the Unlock Condition of the apparatus), the vehicle door 13 is supported on the vehicle body 15 so that the vehicle door 13 is closed. At this time, if an outside handle (not shown in the figures) which is connected with the opening lever 8*b* is operated, the opening lever 8*b* moves linearly and engages the lift lever 8*a* so as to rotate the lift lever 8*a*. With rotation of the lift lever 8*a*, the pole 5*a* is also rotated and disengaged with the latch 5*b* (the Unlatch Condition of the apparatus) so as to permit vehicle door 13 to be opened.

On the other hand, when the electric motor 7*a* is operated, the wheel gear 7*c* is rotated through the worm gear 7*b*. Therefore, the wheel gear 7*c* is engaged with the output lever 7*d* and the output lever 7*d* is also rotated. The rotation of the output lever 7*d* causes rotation of the locking lever 8*c* and the opening lever 8*b* is swung. Consequently, the opening lever 8*b* and the lift lever 8*a* are not engagable with each other (the Lock Condition of the apparatus).

Under the Lock Condition, though the outside handle is operated, the vehicle door lock apparatus is not changed into the Unlatch Condition. Further, an inside handle (not shown in the figures) arranged on the interior side of the door 13 is connected with the lift lever 8*a* for establishing the Latch Condition and the Unlatch Condition of the door lock apparatus. Likewise, an outside handle (not shown) arranged at the exterior of the door is provided for establishing the Latch Condition and the Unlatch Condition of the door lock apparatus. A key cylinder (not shown in the figures) is connected with the locking lever 8*c* in order to selectively change the vehicle door lock apparatus between the Lock Condition and the Unlock Condition. The motor 7*a* is operated by a switch (not shown) located at the interior side of the door 13 for selectively changing between the Lock Condition and the Unlock Condition.

In accordance with the invention, the case 6 is disposed between the body 1 and the mounting portion 13*a* of the vehicle door 13. Since the rear seam portion 16 is covered with the body 1 and the mounting portion 13*a* of the vehicle door 13, the rear seam portion 16 is not exposed to the inside of the vehicle door 13. Further, since the side seam portion 14 is covered with the flange portion 12, the side seam portion 14 is also not exposed to the inside of the vehicle door 13. Therefore, water is prevented from infiltrating the second concave portion 3, in which the actuating mechanism 7 is disposed. Consequently, the actuating mechanism 7 is prevented from becoming rusted.

While the invention has been particularly shown and described with reference to preferred embodiment thereof, it will be understood by those skilled in the art that the foregoing and other changes in form and details can be made therein without departing from the spirit and scope of the invention.

What is claimed is:

1. A vehicle door lock apparatus mounted on a vehicle door comprising:

a body fixed to a mounting portion of a vehicle door;

a latch mechanism disposed in the body for interacting with an element on a vehicle structure to latch the vehicle door relative to the vehicle structure;

a case mounted on the body and disposed between the mounting portion of the vehicle door and the body; and an actuating mechanism surrounded by the body and the case, the case being mounted on a side of the body which faces towards the mounting portion of the vehicle door.

2. A vehicle door lock apparatus as recited in claim 1, wherein the body includes a flange portion extending along at least a portion of the body, the flange portion covering at least a portion of a seam defined between the body and the case.

3. A vehicle door lock apparatus as recited in claim 1, including a seal member disposed between the body and the case.

4. A vehicle door lock apparatus as recited in claim 1, wherein the actuating mechanism includes at least an electric motor.

5. A vehicle door lock apparatus as recited in claim 1, wherein the body includes a flange portion that overlies a seam which extends along opposite side portions of the body, the seam being defined at a juncture between the body and the case.

6. A vehicle door lock apparatus as recited in claim 1, wherein the body includes a first concave portion and a second concave portion, said actuating mechanism being disposed in the second concave portion, the case being mounted on the second concave portion of the body.

7. A vehicle door lock apparatus as recited in claim 1, including an opening lever connected to an outside handle of the vehicle to permit the latch mechanism to become unlatched with respect to the element on the vehicle structure, said opening lever being connected to a locking lever which establishes a locked condition of the vehicle door relative to the vehicle structure, said locking lever being secured to a supporting shaft that extends through the body.

8. A vehicle door lock apparatus as recited in claim 1, wherein said actuating mechanism includes a motor and an output lever mounted on a supporting shaft that extends through the body, said output lever being operatively associated with said motor to rotate in response to operation of the motor.

9. A vehicle door lock apparatus as recited in claim 8, including a locking lever for establishing a locked condition of the door relative to the vehicle structure, said locking lever being secured to said supporting shaft.

10. A vehicle door lock apparatus mounted on a vehicle door comprising:

a body fixed to a mounting portion of a vehicle door, said body having a rear side which faces the mounting portion of the vehicle door, said rear side of the body including a first recessed portion in which is disposed a latch mechanism for interacting with an element of a vehicle structure to latch the vehicle door and a second recessed portion in which is disposed an actuating mechanism; and a case positioned on the rear side of the body and secured to the body to cover the second recessed portion so that the case is disposed between the body and the mounting portion of the vehicle door.

11. A vehicle door lock apparatus as recited in claim 10, including a plate positioned on the rear side of the body and secured to the body to cover the first recessed portion.

12. A vehicle door lock apparatus as recited in claim 10, including an opening lever connected to an outside handle of the vehicle to permit the latch mechanism to become unlatched with respect to the element on the vehicle structure, said opening lever being connected to a locking lever which establishes a locked condition of the vehicle door relative to the vehicle structure, said locking lever being secured to a supporting shaft that extends through the body.

13. A vehicle door lock apparatus as recited in claim 12, wherein said actuating mechanism includes a motor and an output lever mounted on a supporting shaft that extends through the body, said output lever being operatively associated with said motor to rotate in response to operation of the motor.

14. A vehicle door lock apparatus as recited in claim 10, wherein said actuating mechanism includes a motor and an output lever mounted on a supporting shaft that extends through the body, said output lever being operatively associated with said motor to rotate in response to operation of the motor.

* * * * *